US007383670B1

(12) United States Patent
Meyers

(10) Patent No.: US 7,383,670 B1
(45) Date of Patent: Jun. 10, 2008

(54) PANEL BRACKET SYSTEM

(75) Inventor: Lawrence G. Meyers, Layton, UT (US)

(73) Assignee: Ebbe America, LC, Clearfield, UT (US)

( * ) Notice: Subject to any disclaimer, the term of this patent is extended or adjusted under 35 U.S.C. 154(b) by 391 days.

(21) Appl. No.: 10/966,834

(22) Filed: Oct. 13, 2004

(51) Int. Cl.
*E04C 3/30* (2006.01)

(52) U.S. Cl. ..... 52/720.1; 52/733.2; 52/598; 52/309.2; 211/94.01; 211/224.41; 211/224.51; 211/224.61; 248/205.1; 248/200; 248/235; 248/250; 156/71; D25/119; D25/120; D25/121; D25/122

(58) Field of Classification Search ..... 52/720.1, 52/733.2, 598, 309.2; 211/94.01, 224.41, 211/224.51, 224.61; 248/205.1, 200, 235, 248/250; 156/71; D25/119–122
See application file for complete search history.

(56) References Cited

U.S. PATENT DOCUMENTS

| | | | | | |
|---|---|---|---|---|---|
| 2,301,672 | A | * | 11/1942 | Akam | 52/125.3 |
| 3,605,137 | A | * | 9/1971 | Stollenwerk | 5/625 |
| D244,942 | S | * | 7/1977 | Bobrovniczky | D25/120 |
| 4,508,301 | A | * | 4/1985 | Nicholson et al. | 248/250 |
| 4,720,069 | A | * | 1/1988 | Bessinger | 248/250 |
| D319,509 | S | * | 8/1991 | Ogilvie | D25/122 |
| 5,064,158 | A | * | 11/1991 | Brazier et al. | 248/250 |
| 5,243,799 | A | | 9/1993 | Schluter | |
| 5,289,663 | A | | 3/1994 | Schluter | |
| 5,542,218 | A | * | 8/1996 | Rompel | 52/34 |
| D373,738 | S | * | 9/1996 | Nagai et al. | D10/94 |
| 5,927,033 | A | * | 7/1999 | Kreckl | 52/390 |
| 6,082,062 | A | * | 7/2000 | Alflen | 52/202 |
| 6,094,878 | A | | 8/2000 | Schluter | |
| 6,261,394 | B1 | * | 7/2001 | Raineri | 156/63 |
| 6,434,901 | B1 | | 8/2002 | Schluter | |
| 2004/0093816 | A1 | * | 5/2004 | Smythe | 52/255 |

* cited by examiner

*Primary Examiner*—Jeanette Chapman
*Assistant Examiner*—Dan Kenny
(74) *Attorney, Agent, or Firm*—Thorpe North & Western LLP

(57) ABSTRACT

A corner brace configured to support a tile-bearing panel includes a pair of transverse brackets, disposed at a transverse angle to one another and being configured to be disposed in a corner between the tile-bearing panel and another panel or a support surface. At least one of the brackets has at least two ribs, each of which extends from an inner base to an enlarged outer head. The at least two ribs form at least one mortar receiving channel therebetween which has an enlarged chamber and a narrower opening with respect to the enlarged chamber. The mortar receiving channel is configured to at least partially interlock with mortar applied between the panel and the bracket to aid in securing the panel to the corner brace and thus to the other panel or support surface.

12 Claims, 6 Drawing Sheets

PANEL BRACKET SYSTEM

BACKGROUND OF THE INVENTION

1. Field of the Invention

The present invention relates generally to panel support brackets. More particularly, the present invention relates to support brackets for use in bracing support panels for tile installation.

2. Related Art

Installing tile in environments subject to wet conditions, such as shower and bath areas, has been popular for many years. Many such tile installations utilize cementitious mortar, which is used to bond tiles to an underlying attachment surface, after which a cementitious grout material is then applied between the tiles to fill gaps between adjacent tiles. Because grout is generally a porous material, water can and does seep through the grout, and so the eventual presence of water behind (or under) the tiles must be addressed in the tile installation. In general, the water that seeps through the grout should be both prevented from seeping into surrounding structure of the building, such as wall framing or sub flooring, and should be directed in some manner toward a drain of the shower or bath.

To aid in these goals, many conventional tiling installations utilize a vapor barrier of some type, such as plastic sheeting, which is installed against walls or floors over which the tile will be installed. In most applications, a lower vapor barrier, commonly known as the shower pan, is placed where the floor of the shower will be installed and generally extends a short distance up the walls of the shower. The pan is coupled to the drain of the shower in a manner that allows water to flow from the pan into "weep holes" formed in the drain. Sheets of vapor barrier are then attached to walls of the shower such that the wall vapor barriers overlap, and terminate within, the pan. In this manner, water flowing down the wall sheets of vapor barrier will flow into the pan and drain through the weep holes. Thus, water which seeps through the grout of the tile installation travels along the vapor barrier, either on the walls or the floor of the shower, until the water eventually flows into the weep holes of the drain of the shower.

The wall and floor components of the vapor barrier essentially form a "perimeter," about which exists a dry environment, and within which exists a wet environment. Thus, wall framing and sub floor materials about the vapor barrier perimeter can be formed from a variety of materials, including wooden materials, as the framing and sub floor materials will not likely be exposed to moisture. However, any materials within the vapor barrier perimeter should be capable of withstanding a wet environment, due to the seepage of water through the grout of the tile installation.

When a ledge, such as a seat or shelf, is installed in shower areas, the ledge is generally framed within the perimeter of the vapor barrier, and thus must generally be framed from materials which can withstand a wet environment. For this reason, seats or shelves in shower areas are very rarely framed with wooden materials because wooden materials are susceptible to rot when exposed to moisture. Thus, only "non-wooden" materials are generally used to frame seats or shelves in shower or bath areas.

The most common conventional method of utilizing non-wooden materials for framing seats or shelves involves the placement of cement blocks or bricks within the vapor barrier perimeter. The cement blocks are generally placed in the location where the seat or shelf is to be tiled and are arranged to form the shape of the seat or shelf. Generally, the concrete blocks are placed or installed into position and an often large quantity of brick mortar is used to fill voids in and between the blocks or bricks, and to provide a smooth finish over the blocks or bricks. Multiple applications of brick mortar are often necessary to ensure that the seat frame is true and sufficiently smooth to receive tiles. This process results in a substantially solid seat or shelf being formed from bricks or blocks that are partially filled with and covered by mortar. Once this solid "frame" of the seat or shelf is completed, tile can be set or laid upon the frame in the finished tile installation.

While this method has proven at least partially effective in some applications, it suffers from a number of problems. For example, as cement blocks and brick mortar are relatively heavy materials, use of them as "framing" material adds considerably to the weight of the overall installation. In addition, due to the large quantity of brick mortar used, erection of the underlying "frame" for a conventional tiled seat typically takes at least a full day of work and cure time before tile can be set or laid over the block frame. Also, the use of square or rectangular bricks or blocks often limits the choice of geometry of the seat or shelf, as forming elaborate shapes becomes difficult when using square or rectangular frame components.

For at least these reasons, framing of tile seats or shelves for use in wet environments remains problematic to tile installers.

SUMMARY OF THE INVENTION

It has been recognized that it would be advantageous to develop a system for framing seats, shelves or ledges to receive tiles for use in wet environments that minimizes weight associated with the framing and provides greater flexibility for altering sizes and heights of the seats, shelves or ledges.

The present invention provides a corner brace configured to support a tile-bearing panel, including a pair of brackets, disposed at a transverse angle to one another and being configured to be disposed in a corner between the tile-bearing panel and another panel or a support surface. At least one of the brackets can have at least two ribs, each of which can extend from an inner base to an enlarged outer head. The at least two ribs can form at least one mortar receiving channel therebetween which can have an enlarged chamber and a narrower opening with respect to the enlarged chamber. The mortar receiving channel can be configured to at least partially interlock with mortar applied between the panel and the bracket to aid in securing the panel to the corner brace and thus to the other panel or support surface.

In accordance with another aspect of the invention, a method for bracing a tile-bearing panel is provided, including the steps of: applying mortar to at least one of: i) the panel; and ii) a bracket of a corner brace being configured to be coupled to the panel to support the panel; pressing the panel and bracket together to interlock the bracket within the mortar by forcing the mortar into a mortar receiving channel formed between at least two ribs associated with the bracket, the mortar receiving channel having an enlarged chamber and a narrower opening with respect to the enlarged chamber; affixing another bracket of the corner brace to another panel or a support surface; and retaining the bracket of the corner brace adjacent the panel until the mortar cures within the mortar receiving channel to couple the bracket to the panel.

In accordance with another aspect of the invention, a method for forming a tiled ledge for use in a wet environment is provided, including the steps of: attaching at least one corner brace to a wall; applying mortar to at least one of: i) a tile-bearing panel of the ledge; and ii) a bracket of the corner brace being configured to be coupled to the panel; pressing the panel and bracket together to interlock the bracket within the mortar by forcing the mortar into a mortar receiving channel formed between at least two ribs associated with the bracket, the mortar receiving channel having an enlarged chamber and a narrower opening with respect to the enlarged chamber; retaining the bracket of the corner brace adjacent the panel until the mortar cures within the mortar receiving channel and couples the bracket to the panel; and applying tiles to the tile-bearing panel.

Additional features and advantages of the invention will be apparent from the detailed description which follows, taken in conjunction with the accompanying drawings, which together illustrate, by way of example, features of the invention.

DETAILED DESCRIPTION

Figure 1:
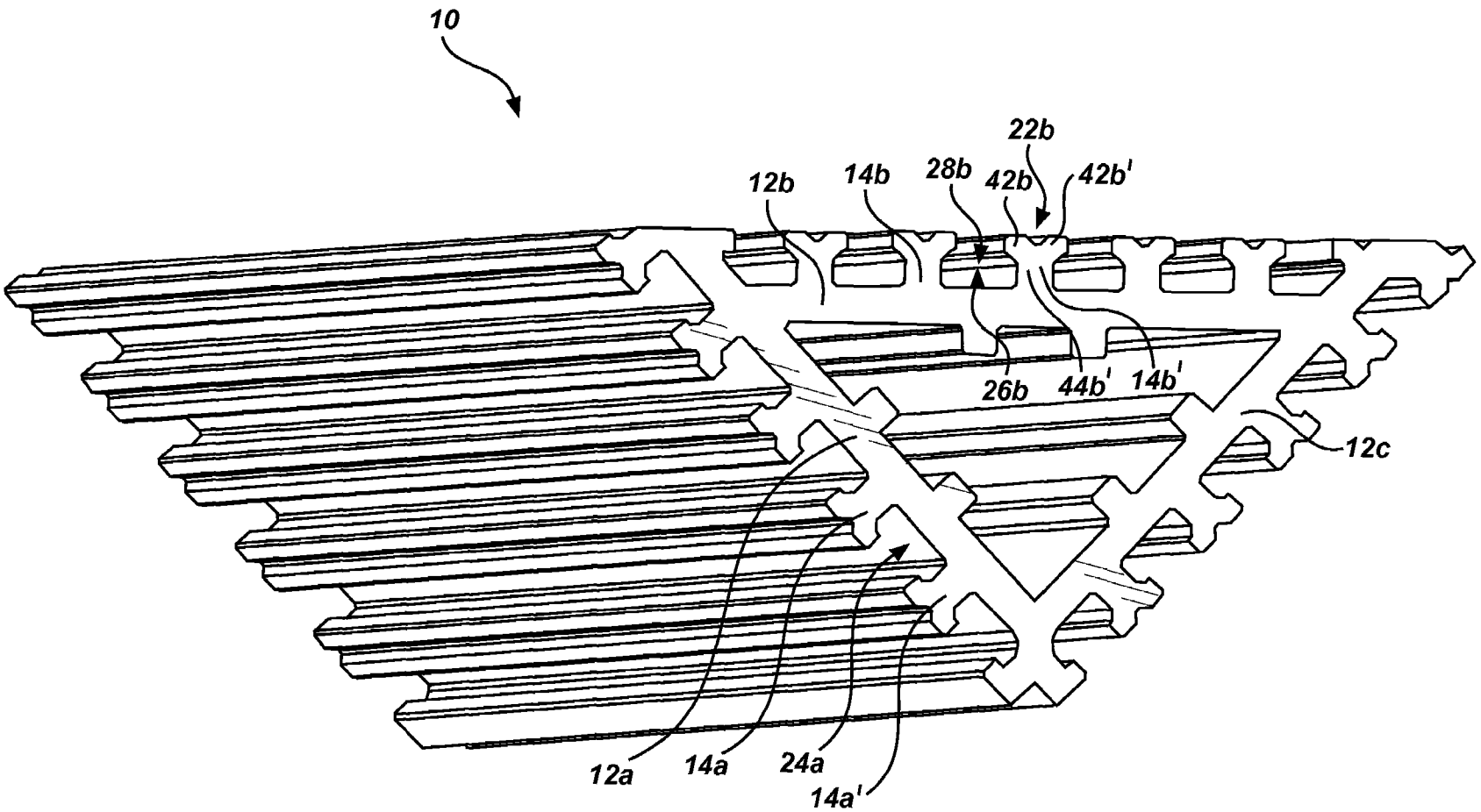
FIG. 1 is a perspective view of a corner brace in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2A:
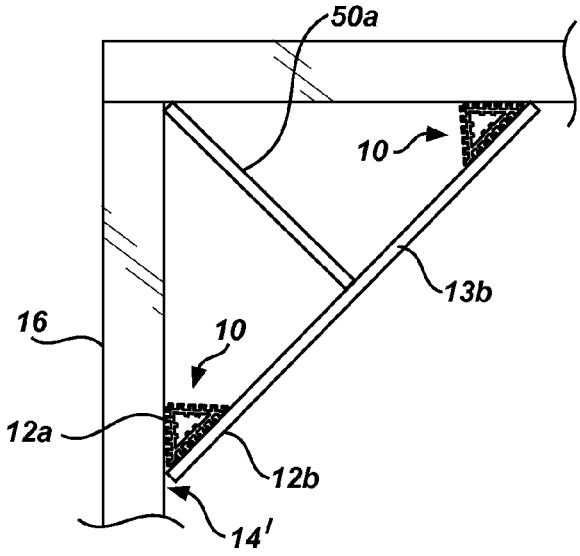
FIG. 2A is a top view of a partially framed triangular bath or shower seat in accordance with one aspect of the invention.
Figure 2B:
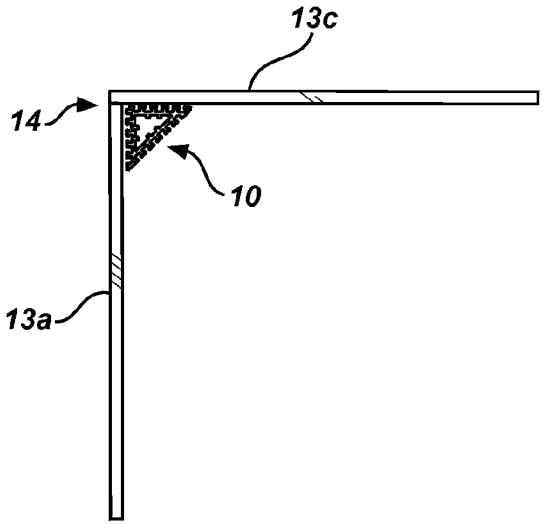
FIG. 2B is a side view of a partially framed bath or shower seat in accordance with one aspect of the invention.
Figure 3:
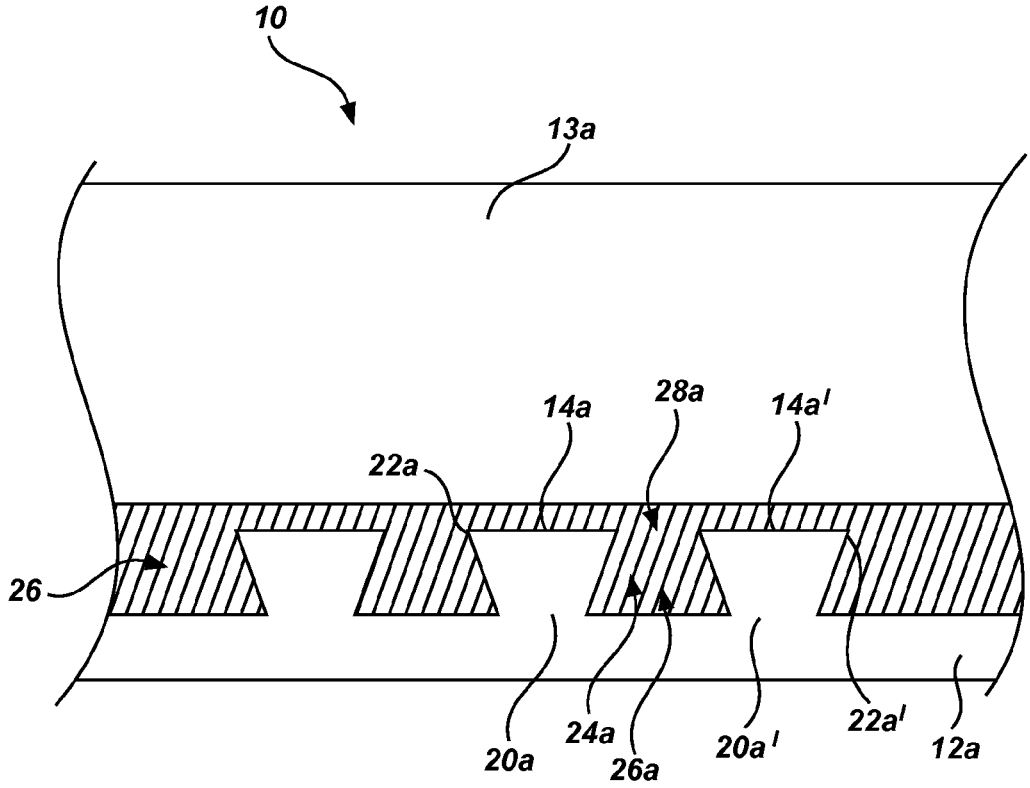
FIG. 3 is a sectional view of a backer board and corner brace coupled together with mortar in accordance with one aspect of the invention.

As illustrated in FIGS. 1 and 3, in accordance with one embodiment of the invention, a corner brace 10 is shown configured to support a tile-bearing panel (13*a* in FIG. 3). The corner brace can include a pair of brackets, 12*a* and 12*b*, which can be disposed at a transverse angle to one another. As shown in FIG. 2B, the brackets can be configured to be disposed in a corner 14 between the tile-bearing panel 13*a* and another tile-bearing panel 13*c*. Alternately, as shown in FIG. 2A, the bracket can be configured to be disposed in a corner 14' between the tile bearing panel 13*b* and a support surface 16, such as pre-existing wall framing.

At least one of the brackets, for example 12*a* in FIG. 3, can have at least two ribs 14*a* and 14*a*' extending therefrom. The ribs can each extend from an inner base 20*a* and 20*a*', respectively, to an enlarged outer head 22*a* and 22*a*', respectively. The at least two ribs can thus form at least one mortar receiving channel 24*a* therebetween. The mortar receiving channel can have an enlarged chamber 26*a* and a narrower opening 28*a* with respect to the enlarged chamber. In use, the mortar receiving channel can at least partially interlock with mortar (26 in FIG. 3) applied between the panel 13*a* and the bracket 12*a* to aid in securing the panel to the corner brace, and thus to another panel or a support surface.

By at least partially interlocking with mortar applied between the panel 13*a* and the bracket 12*a*, the mortar receiving channel 24*a* provides a mechanical coupling between the bracket and the panel; as the mortar becomes "locked" in the receiving channel after cure. This mechanical coupling is in addition to any chemical bonding that may occur between the mortar and the bracket of the brace. This feature of the invention is advantageous in the embodiments of the invention that include a brace formed of a polymeric material, as conventional mortar materials may not bond well chemically with the polymeric brace. By forming the mortar receiving channel between at least two ribs 14*a* and 14*a*', the mortar applied to the brace is forced past the narrower opening 28*a* of the mortar receiving channel and "sets up," or cures, within the enlarged chamber 26*a*, thereby forming a mechanical interlock between the brace and the mortar, and thus the support panel 13*a*. The present invention thus advantageously allows the brace to be formed from a lightweight, durable material even in the case where the lightweight material utilized may not bond well with conventional mortar products.

The corner brace of the present invention can thus be used to brace or support a tile-bearing panel to allow the tile bearing panel to be secured to another panel, or to some other supporting structure, such as a wall of a building. In a typical scenario, shown by example in top view in FIG. 2A, a method of utilizing the corner bracket can include the steps of applying mortar to at least one of: i) the panel 13*b* and ii) a bracket 12*b* of the corner brace 10 configured to be coupled to the panel to support the panel. The panel and bracket can then be pressed together to interlock the bracket within the mortar by forcing the mortar into the mortar receiving channel (24*a* in FIG. 3) formed between the at least two ribs (14*a*, 14*a*' in FIG. 3) associated with the bracket.

The method can include the further step of affixing another bracket (12*a* in FIG. 2A) of the corner brace to a support surface (16 in FIG. 2A). The bracket of the corner brace can then be held adjacent the panel until the mortar cures within the mortar receiving channel to couple the bracket to the panel. The support surface 16 can be a variety of structures, including conventional wall framing materials, finished walls, etc., as may be present in areas where it is wished to install a bath or shower enclosure. Alternately, as shown by example in side view in FIG. 2B, the corner bracket can be disposed adjacent edges of two tile-bearing panels, 13*a* and 13*c*, to couple the tile-bearing panels to one another.

The corner brace can be formed from a variety of materials, including cementitious materials, metals, plastics, etc., or a combination or composite of one or more materials. In one aspect of the invention, the corner brace is formed of a water resistant material. As used herein, the term "water resistant material" is to be understood to refer to a material that is substantially impervious to significant deterioration due to contact with water. Such materials can include, for example, cementitious materials, aluminum, polymers, stainless steel, etc. In one embodiment of the invention, the water resistant material includes high-impact polystyrene. Braces of the present invention formed of high-impact polystyrene can be manufactured through a variety of methods known to those skilled in the art, including protrusion, pultrusion, injection-molding, etc.

The tile-bearing panel can similarly be formed from a number of materials, including, in one aspect of the invention, material commonly referred to as "backer board," which is a cementitious material formed in a sheet, similar in appearance to gypsum drywall. Backer board is commonly used on floors to provide a relatively stiff underlying surface on which tiles are laid. As the backer board is generally formed from cementitious materials, conventional cementitious mortar provides a good bond between the tiles and the backer board. Suitable types of backer board include, without limitation, cementitious backer boards having paper and/or fiberglass fillers, and gypsum backer boards having paper and/or fiberglass fillers. While it is contemplated that conventional cementitious mortar can be utilized with the present invention, in some embodiments of the invention, the mortar can include epoxy mortar, polymer modified cementitious mortar, epoxy adhesives and combinations or variations thereof.

While corner braces in accordance with the present invention can be used in a variety of applications, the brace can be particularly effective when used in framing a seat or other such ledge or projection that will be subject to a wet environment, such as in a bath or shower area. As shown for example in FIG. 4, a plurality of corner braces can be used to frame a square or rectangular seat 31 in a shower enclosure. In this aspect of the invention, a plurality of corner braces 10 can be disposed along edges 30*a* and 30*c* of tile-bearing panels or backer boards 13*a* and 13*c*, respectively, to couple the backer boards to each other at the front corner of the seat. A plurality of braces can also be coupled to walls of the shower enclosure, in both vertical and horizontal orientations, to secure the panels to the walls. As shown in side view in FIG. 2B, the top, horizontal panel 13*c* can generally be disposed over the vertical panel 13*a* such that the vertical panel can aid in supporting the weight carried by horizontal panel 13*c*.

Figure 2C:
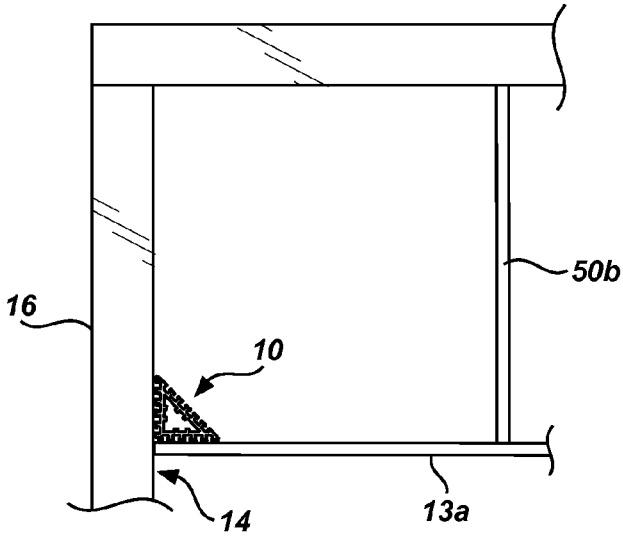
FIG. 2C is a top view of a partially framed rectangular bath or shower seat in accordance with one aspect of the invention.
Figure 4:
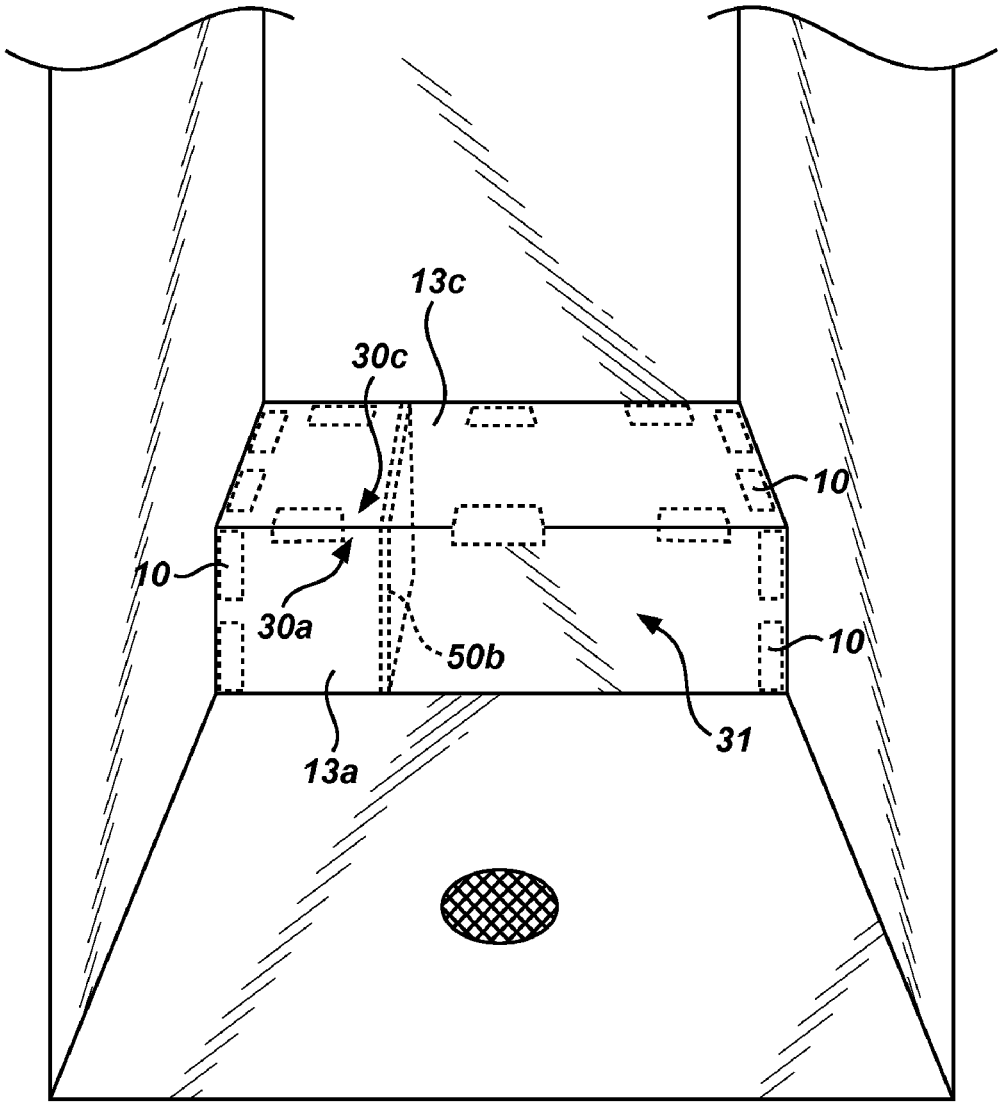
FIG. 4 is a partial perspective view of a shower having a rectangular seat framed therein in accordance with one aspect of the invention.

FIG. 2C illustrates a section of the rectangular seat of FIG. 4 in top view, with upper, horizontal panel 13*c* and any horizontal braces 10 removed for clarity. As shown, vertical brace 10 of FIG. 2C is coupled to bath or shower wall 16 via means known to those skilled in the art, such as by bonding, coupling with threaded fasteners, nailing, etc. Mortar (not shown in FIG. 2C) can then be applied to secure panel 13*a* to the corner brace 10 to complete the bracing with respect to wall 16. In this aspect of the invention, bulkhead 50*b* can be installed in a substantially vertical orientation to aid in supporting upper, horizontal panel 13*c* (FIG. 4). While one bulkhead 50*b* is shown in FIG. 4, two or more bulkheads can be utilized to add support to the overall structure. The bulkhead can be formed from a variety of materials and can include a section of backer board formed in a shape corresponding to the shape of the seat or bench being formed.

Figure 5:
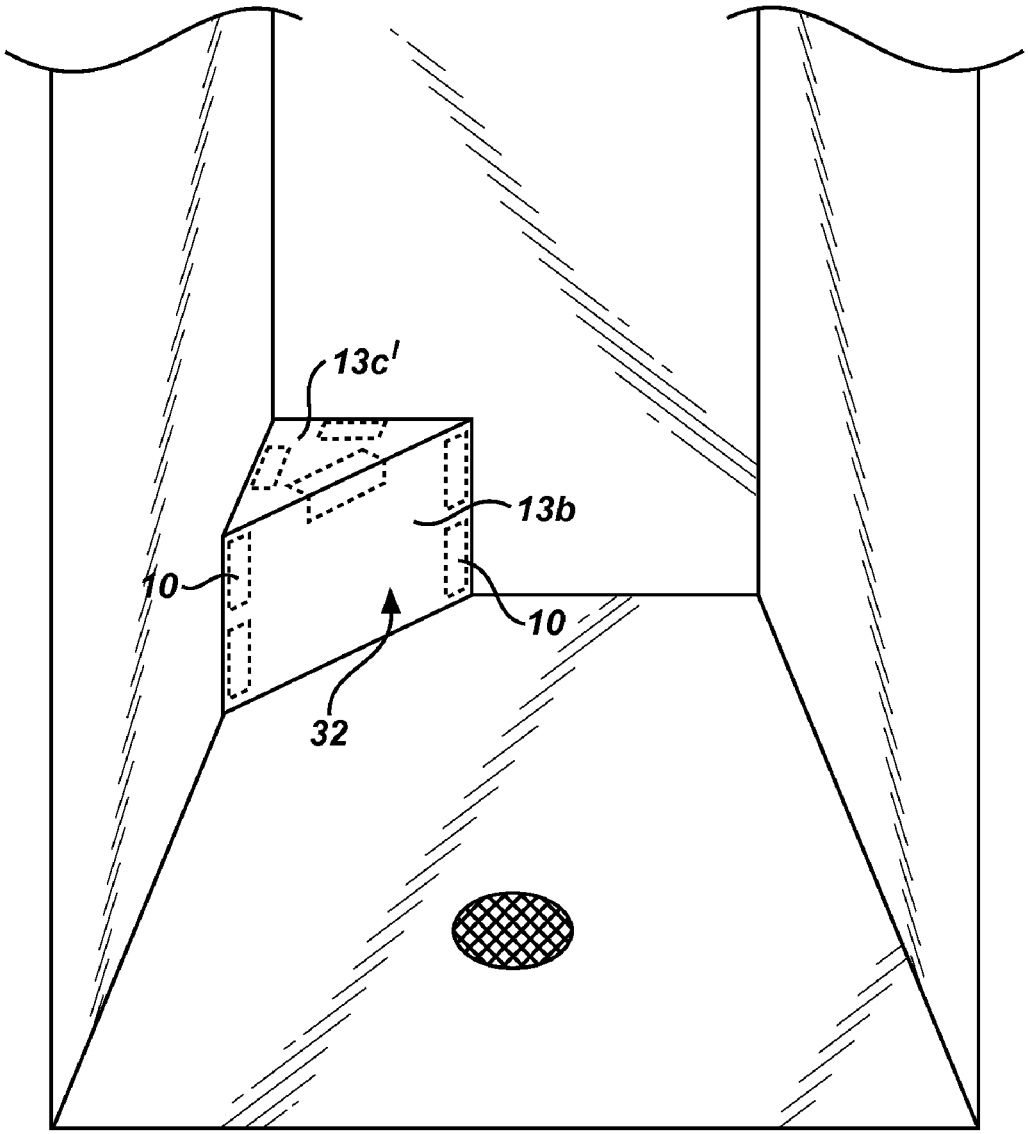
FIG. 5 is a partial perspective view of a shower having a triangular seat framed therein in accordance with one aspect of the invention.

FIG. 5 illustrates a similar configuration in which seat 32 is formed in a substantially triangular shape. As illustrated, vertical panel 13*b* is formed in a substantially rectangular shape while upper, horizontal panel 13*c*' is formed in a triangular shape. Shown in top view in FIG. 2A, with upper panel 13*c*' removed for clarity, it will be appreciated that the corner braces of the present invention can be used to brace panels or walls meeting in corners having a variety of angular configurations. Thus, as used herein, the term "transverse angle" is to be understood to refer to a relationship in which the brackets of the brace extend away from each other at some angle such that the brackets are not parallel.

Figure 6A:
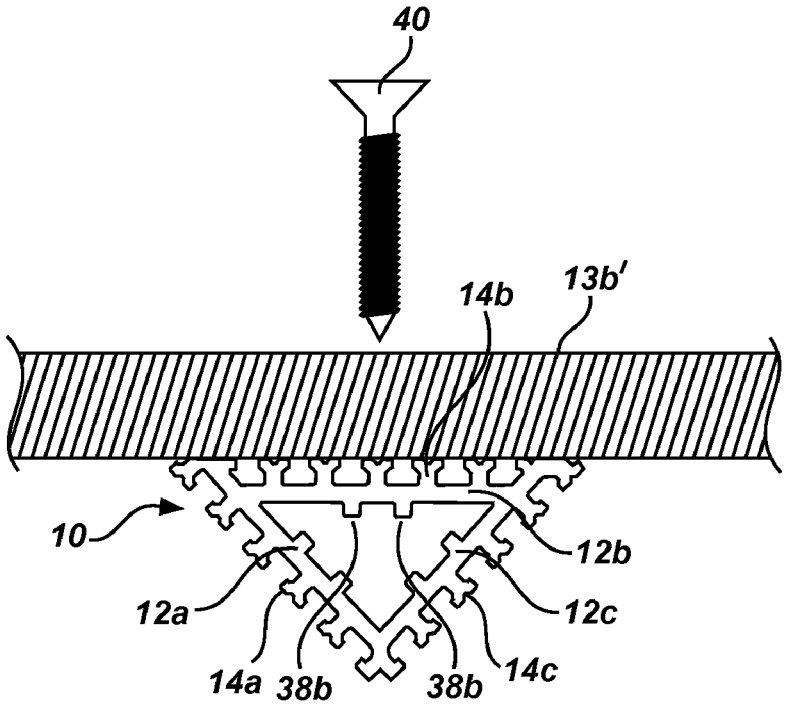
FIG. 6A is a partial, cutaway view of a tile-bearing panel and corner brace in accordance with one aspect of the invention.

For example, the corner braces 10 shown in FIG. 2A can be used to brace a square, or 90 degree corner; or a triangular, or 45 degree corner, merely by changing the angle at which the brace is coupled or placed in the corner. As shown by example in FIG. 6A, the corner brace 10 of the present invention can also include a third bracket 12*c* which can be disposed at a transverse angle with respect to the pair, 12*a* and 12*b*, of brackets. In this aspect, the pair of brackets and the third bracket can define a substantially triangular cross section. As shown in FIG. 6A, the pair of brackets and the third transverse bracket can define a substantially right triangle with one of the angles of the brace forming a 90 degree angle and the remaining corners of the brace forming 45 degree angles. In addition to the brackets 12 of the brace 10 forming 90 or 45 degree angles with respect to each other, it is contemplated that a variety of angles can be formed to provide further flexibility to tile installers. For example, in the case where an octagonally-shaped structure is to be framed, a series of braces having brackets forming 135 degree angles with respect to each other could be utilized.

Similar to bulkhead 50*b* of FIGS. 4 and 2C, the aspect of the invention shown in FIG. 2A can include bulkhead 50*a* which can provide additional support to the triangularly shaped seat (note that bulkhead 50*a* is omitted from FIG. 5 in the interest of clarity). The various bulkheads of the present invention can be formed in a variety of shapes and can be placed within the enclosure formed by the support panels in a variety of locations, as dictated by the particular seat or shelf being formed.

The corner braces of the present invention can offer a tile installer great flexibility in framing a ledge or seat in a tub or bath installation. As discussed, the braces can allow an installer to form angles of varying degree. In addition, the overall length of the braces can be varied to provide flexibility. For example, in one aspect of the invention, the overall length of the brace can be relatively short, on the order of being twice a width of either of the pair of brackets 12*a*, 12*b*. In this manner, a series of braces can be coupled along an edge of a tile-bearing panel or other support structure to brace one or more tile-bearing panels, similar to the arrangement illustrated in FIG. 4, where three braces 10 are disposed along edges 30*a*, 30*c* of the panels 13*a* and 13*c*, respectively.

Braces having relatively short lengths have proven advantageous in providing flexibility to the framing process, as the installer can easily attach one or more braces, as needed, along an edge of a panel, as dictated by the installation at hand. The installer thus need not cut the braces to length, as the case would be when the frame for a seat or ledge is formed from elongate lumber material. In addition, the relatively short length of the braces can allow a height of the ledge or shelf to be customized without requiring that the installer form the height of the ledge accordingly to a predetermined size of the bracing material, such as is the case when cement blocks are used as framing material.

Returning now to FIG. 1, the ribs 14*a*, 14*a*' can extend along a longitudinal axis of the brace in a direction generally parallel with the longitudinal axis. In one aspect of the invention, the ribs can extend across substantially all of the length of the brace. In this manner, the mortar receiving channel 24*a* can provide a mechanical interlock between the brace and the support panel across substantially the entire brace once the mortar has cured within the enlarged chamber of the receiving channel.

Figure 6B:
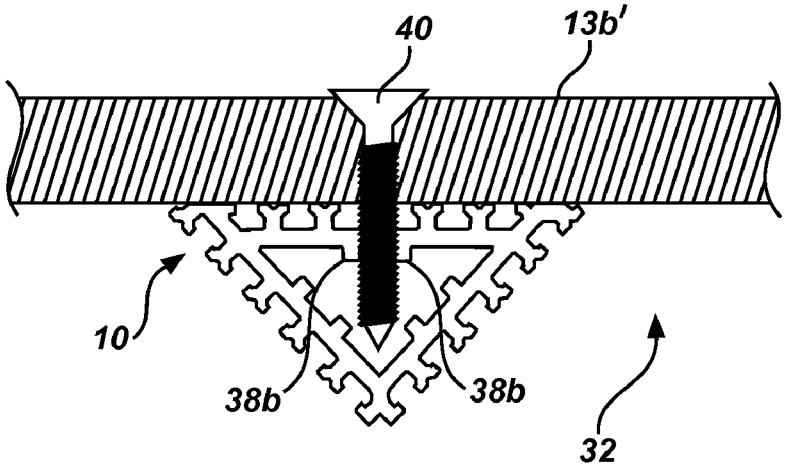
FIG. 6B is a partial, cutaway view of a tile-bearing panel and corner brace in accordance with one aspect of the invention with a fastener driven through the panel and the brace.

Additional features of the invention are illustrated in FIGS. 6A and 6B. In this aspect of the invention the corner brace 10 can include at least one engageable lug 38*b* extending from the bracket 12*b* on a side of the bracket opposite the ribs 14*b*. The lug can be configured to provide supplemental engagement material for a fastener 40 driven through the brace. In this manner, after mortar is applied between the brace and the panel 13*b*', fastener 40 can be driven through the panel and into and through the bracket 12*b* to couple the bracket and the panel until the mortar cures, as shown in FIG. 6B (note that, in the interest of clarity, mortar between the brace and panel is not shown in FIGS. 6A and 6B). The engageable lugs can provide supplemental engagement material to the brace without significantly increasing the amount of material required to form the brace. In the case where a fastener is driven through bracket 12*b* in a location that does not engage the lugs, the fastener will likely pierce and engage one of the other brackets, such as 12*a* or 12*c*, to securely engage the overall brace 10.

Returning again to FIG. 1, rib 14*b* can include a pair of shoulders 42*b*, 42*b*' that can extend from a central portion 44*b*' of the rib. The pair of shoulders can define the enlarged outer head 22*b*. In this aspect of the invention, the size of the enlarged chamber 26*b* can be increased relative to the narrower opening 28*b* to allow more mortar to fill the enlarged chamber. It is believed that expanding the mortar receiving space, and thus increasing the amount of mortar in engagement with the bracket, can increase the strength of the mechanical interlock between the bracket and the panel. In addition, while not shown in the figures, by increasing the width of the mortar receiving channel, a head of a threaded fastener, such as a screw, can "snap" into the mortar receiving channel past the pair of shoulders and nest within the mortar receiving channel. This feature can be advantageous in applications where it is desired to threadably engage or screw a tile-bearing panel, or other support material, from a back side of the brace.

Returning to FIG. 2B, where a rectangular seat formed in accordance with the present invention is shown, tile bearing panel 13*a* is shown generally as being oriented in a substantially vertical orientation. While not shown in the figures, the tile bearing panel 13*a* can also be oriented in a slanted, or tipped, configuration to allow a lower portion of the seat to be recessed below an upper portion of the seat. In this aspect, the sloped frontal portion can allow a user to extend his or her feet beneath the seat when the user is seated. In addition, it is contemplated that the front, or side, profile of a seat or shelf formed in accordance with the present invention can be formed in a stepped configuration (not shown) which can provide both a recessed lower portion as well as a decorative appearance. The sloped or stepped configurations can extend outwardly or inwardly from or beneath the top of the seat or shelf, as a particular installation dictates. In this manner, the tile installer is afforded great flexibility to erect seats or shelves having various sizes and geometries.

It will be appreciated that seats or shelves formed in accordance with the present invention are framed by a series of panels which define a frame or enclosure having a variety of shapes. In addition to providing sufficient support to bear the weight of users or goods on the seat or shelf, the enclosure can be utilized to provide a variety of effects to the bath or shower area. For example, air vents or steam supply lines (not shown) can be routed through the enclosure to provide ventilation or steam to the shower area. In addition, lighting fixtures (not shown) can be disposed within the enclosure to provide utility and/or decorative lighting effects to the bath or shower area.

The present invention also provides methods for utilizing the corner braces discussed herein. The methods can be utilized to brace a tile-bearing panel and can include the steps of: applying mortar to at least one of: i) the panel; and ii) a bracket of a corner brace being configured to be coupled to the panel to support the panel; pressing the panel and bracket together to interlock the bracket within the mortar by forcing the mortar into a mortar receiving channel formed between at least two ribs associated with the bracket, the mortar receiving channel having an enlarged chamber and a narrower opening with respect to the enlarged chamber; affixing another bracket of the corner brace to another panel or a support surface; and retaining the bracket of the corner brace adjacent the panel until the mortar cures within the mortar receiving channel to couple the bracket to the panel.

The methods can also be utilized to form a tiled ledge for use in a wet environment, and in one embodiment can include the steps of: attaching at least one corner brace to a wall; applying mortar to at least one of: i) a tile-bearing panel of the ledge; and ii) a bracket of the corner brace being configured to be coupled to the panel; pressing the panel and bracket together to interlock the bracket within the mortar by forcing the mortar into a mortar receiving channel formed between at least two ribs associated with the bracket, the mortar receiving channel having an enlarged chamber and a narrower opening with respect to the enlarged chamber; retaining the bracket of the corner brace adjacent the panel until the mortar cures within the mortar receiving channel and couples the bracket to the panel; and applying tiles to the tile-bearing panel.

It is to be understood that the present invention can be utilized in erecting shelves or seats in both new bath or shower installations and in existing bath or shower areas. For example, brackets in accordance with the present invention can be attached within existing tile baths or showers by utilizing an epoxy capable of bonding the brackets to tiled surfaces. In this manner, a seat or shelf can be installed within a bath or shower area that has already been tiled. In addition, while the seat or shelf shown in FIGS. 4 and 5 is attached adjacent one or more walls, it is to be understood that the present invention can be utilized to install "free-standing" seats or shelves in a tiled area that are not supported by adjacent walls.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

I claim:

1. A combination corner brace and tile-bearing panel, comprising:

the tile-bearing panel comprising a backer board;

a pair of brackets, disposed at a angle to one another and being configured to be disposed in a corner between the tile-bearing panel and another panel or a support surface;

each of the brackets having at least two ribs, each rib extending from an inner base to an enlarged outer head;

the at least two ribs forming at least one mortar receiving channel therebetween having an enlarged chamber and a narrower opening with respect to the enlarged chamber, the mortar receiving channel being configured to at least partially interlock with mortar applied between the panel and the bracket to aid in securing the panel to the corner brace and thus to the other panel or support surface.

2. The combination of claim 1, further comprising a third bracket, disposed at a angle with respect to the pair of brackets, the pair of brackets and the third bracket defining a substantially triangular cross section and wherein the third bracket includes at least two ribs, each rib extending from an inner base to an enlarged outer head.

3. The combination of claim 1, further comprising a third bracket, disposed at a angle with respect to the pair of brackets, the pair of brackets and the third bracket defining a substantially right triangle.

4. The combination of claim 1, wherein the brace is comprised of a water resistant material.

5. The combination of claim 4, wherein the water resistant material comprises high-impact polystyrene.

6. The combination of claim 1, wherein the brace has a length at least twice a width of either of the pair of brackets.

7. The combination of claim 6, wherein the ribs extend along a longitudinal axis of the brace.

8. The combination of claim 7, wherein the ribs extend along the longitudinal axis of the brace across substantially all of the length of the brace.

9. The combination of claim 1, further comprising at least one engageable lug extending from the bracket on a side of the bracket opposite the ribs, the lug being configured to provide supplemental engagement material for a fastener driven through the brace.

10. The combination of claim 1, wherein the ribs each include a pair of shoulders extending from a central portion, the pair of shoulders defining the enlarged outer head.

11. The combination of claim 1, wherein the enlarged outer heads each include a pair of shoulders extending substantially symmetrically relative to one another from a central portion of the rib.

12. The combination of claim 1, wherein the enlarged outer heads each include a pair of shoulders, the shoulders being substantially the same size and shape.

* * * * *